US008080940B2

(12) United States Patent
Oh et al.

(10) Patent No.: US 8,080,940 B2
(45) Date of Patent: Dec. 20, 2011

(54) PLASMA DISPLAY PANEL

(75) Inventors: Jaeyoung Oh, Gumi (KR); Woogon Jeon, Gumi (KR); Heerak Kim, Gumi (KR); Daeil Han, Gumi (KR)

(73) Assignee: LG Electronics Inc., Seoul (KR)

( * ) Notice: Subject to any disclaimer, the term of this patent is extended or adjusted under 35 U.S.C. 154(b) by 1015 days.

(21) Appl. No.: 11/966,491

(22) Filed: Dec. 28, 2007

(65) Prior Publication Data

US 2008/0284682 A1 Nov. 20, 2008

(30) Foreign Application Priority Data

May 18, 2007 (KR) ..... 10-2007-0048604
Aug. 2, 2007 (KR) ..... 10-2007-0077690
Aug. 2, 2007 (KR) ..... 10-2007-0077692

(51) Int. Cl.
*H01J 17/49* (2006.01)

(52) U.S. Cl. ..... 313/587; 313/582; 313/586

(58) Field of Classification Search ..... 313/582–587
See application file for complete search history.

(56) References Cited

U.S. PATENT DOCUMENTS 6,242,859 B1 6/2001 Betsui et al. ..... 313/584
7,019,461 B2 3/2006 Harada ..... 313/586
2003/0015963 A1 1/2003 Tanaka ..... 313/582
2003/0137245 A1 7/2003 Nakatani et al. ..... 313/582
2006/0001373 A1 1/2006 Nonomura et al. ..... 313/582

FOREIGN PATENT DOCUMENTS

JP 2001-236896 A 8/2001
JP 2003-297253 A 10/2003
JP 2006-310050 A 9/2006
KR 10-2006-0045275 A 5/2006
WO WO 00/31580 6/2000

OTHER PUBLICATIONS

U.S. Final Office Action dated Apr. 28, 2010 for U.S. Appl. No. 11/966,581.
European Search Report dated Jun. 9, 2009 for Application No. 07 860 829.6.
PCT International Search Report and Written Opinion dated Apr. 23, 2008 for Application No. PCT/KR2007/007054.
European Search Report dated Jul. 13, 2009.
PCT International Search Report dated Apr. 23, 2008.
U.S. Office Action dated Oct. 29, 2009 for U.S. Appl. No. 11/966,581.

*Primary Examiner* — Bumsuk Won
(74) *Attorney, Agent, or Firm* — KED & Associates LLP

(57) ABSTRACT

A plasma display panel is disclosed. The plasma display panel includes a front substrate, a rear substrate positioned to be opposite to the front substrate, a barrier rib positioned between the front substrate and the rear substrate, and a seal layer positioned between the front substrate and the rear substrate. The seal layer includes a plurality of beads, and a size of the bead is larger than a height of the barrier rib.

15 Claims, 20 Drawing Sheets

FIG. 5C

| t1/R | Dielectric breakdown | | | |
|---|---|---|---|---|
| | 192V | 242V | 360V | 485V |
| 0.1 | ○ | × | × | × |
| 0.125 | ○ | ○ | ○ | × |
| 0.13 | ○ | ○ | ○ | ○ |
| 0.14 | ○ | ○ | ○ | ○ |
| 0.17 | ○ | ○ | ○ | ○ |
| 0.21 | ○ | ○ | ○ | ○ |
| 0.25 | ○ | ○ | ○ | ○ |
| 0.32 | ○ | ○ | ○ | ○ |
| 0.35 | ○ | ○ | ○ | ○ |
| 0.38 | ○ | ○ | ○ | ○ |
| 0.42 | ○ | ○ | ○ | ○ |
| 0.46 | ○ | ○ | ○ | ○ |
| 0.47 | ○ | ○ | ○ | ○ |

| $t_1/R$ | Drive efficiency |
|---|---|
| 0.1 | ◎ |
| 0.125 | ◎ |
| 0.13 | ◎ |
| 0.14 | ◎ |
| 0.17 | ◎ |
| 0.21 | ◎ |
| 0.25 | ◎ |
| 0.32 | ◎ |
| 0.35 | ◎ |
| 0.38 | ○ |
| 0.42 | ○ |
| 0.46 | × |
| 0.47 | × |

FIG. 6B

| t2/R | Dielectric breakdown | | | |
|---|---|---|---|---|
| | 190V | 235V | 320V | 452V |
| 0.03 | ○ | × | × | × |
| 0.05 | ○ | ○ | ○ | × |
| 0.055 | ○ | ○ | ○ | ○ |
| 0.08 | ○ | ○ | ○ | ○ |
| 0.09 | ○ | ○ | ○ | ○ |
| 0.1 | ○ | ○ | ○ | ○ |
| 0.13 | ○ | ○ | ○ | ○ |
| 0.14 | ○ | ○ | ○ | ○ |
| 0.15 | ○ | ○ | ○ | ○ |
| 0.17 | ○ | ○ | ○ | ○ |
| 0.20 | ○ | ○ | ○ | ○ |
| 0.21 | ○ | ○ | ○ | ○ |

FIG. 6C

| t2/R | Drive efficiency |
|---|---|
| 0.03 | ◎ |
| 0.05 | ◎ |
| 0.055 | ◎ |
| 0.08 | ◎ |
| 0.09 | ◎ |
| 0.1 | ◎ |
| 0.13 | ◎ |
| 0.14 | ◎ |
| 0.15 | ○ |
| 0.17 | ○ |
| 0.20 | × |
| 0.21 | × |

| R/h | Noise | Crosstalk |
|---|---|---|
| 0.9 | X | ○ |
| 0.95 | X | ◎ |
| 1.01 | ○ | ◎ |
| 1.04 | ◎ | ◎ |
| 1.2 | ◎ | ◎ |
| 1.3 | ◎ | ◎ |
| 1.37 | ◎ | ◎ |
| 1.45 | ◎ | ○ |
| 1.7 | ◎ | X |
| 1.8 | ◎ | X |

PLASMA DISPLAY PANEL

This application claims the benefit of Korean Patent Application Nos. 10-2007-0048604 filed on May 18, 2007, 10-2007-0077690 filed on Aug. 2, 2007 and 10-2007-0077692 filed on Aug. 2, 2007 which are hereby incorporated by reference.

BACKGROUND OF THE DISCLOSURE

1. Field of the Disclosure

This document relates to a plasma display panel.

2. Description of the Related Art

A plasma display panel includes a phosphor layer inside discharge cells partitioned by barrier ribs and a plurality of electrodes.

When driving signals are applied to the electrodes of the plasma display panel, a discharge occurs inside the discharge cells. In other words, when the plasma display panel is discharged by applying the driving signals to the discharge cells, a discharge gas filled in the discharge cells generates vacuum ultraviolet rays, which thereby cause phosphors positioned between the barrier ribs to emit light, thus producing visible light. An image is displayed on the screen of the plasma display panel due to the visible light.

SUMMARY OF THE DISCLOSURE

In one aspect, a plasma display panel comprises a front substrate, a rear substrate positioned to be opposite to the front substrate, a barrier rib positioned between the front substrate and the rear substrate, and a seal layer positioned between the front substrate and the rear substrate, the seal layer including a plurality of beads, a size of the bead being larger than a height of the barrier rib.

In another aspect, a plasma display panel comprises a front substrate, a rear substrate positioned to be opposite to the front substrate, a barrier rib positioned between the front substrate and the rear substrate, and a seal layer positioned between the front substrate and the rear substrate, the seal layer including a plurality of beads, at least one of the plurality of beads including a head portion, a body portion, and a connection portion connecting the head portion to the body portion.

In yet another aspect, a plasma display panel comprises a front substrate on which an upper dielectric layer is positioned, a rear substrate on which a lower dielectric layer is positioned, the rear substrate being opposite to the front substrate, a barrier rib positioned between the front substrate and the rear substrate, and a seal layer positioned between the front substrate and the rear substrate, the seal layer including a plurality of beads, wherein a ratio of a thickness of the upper dielectric layer to a size of the bead ranges from 0.125 to 0.42.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings:

FIGS. 5A to 5D are diagrams for explaining a relationship between a bead and a thickness of an upper dielectric layer;

FIGS. 6A to 6C are diagrams for explaining a relationship between a bead and a thickness of a lower dielectric layer;

DETAILED DESCRIPTION OF EMBODIMENTS

Reference will now be made in detail embodiments of the invention examples of which are illustrated in the accompanying drawings.

Figure 1:
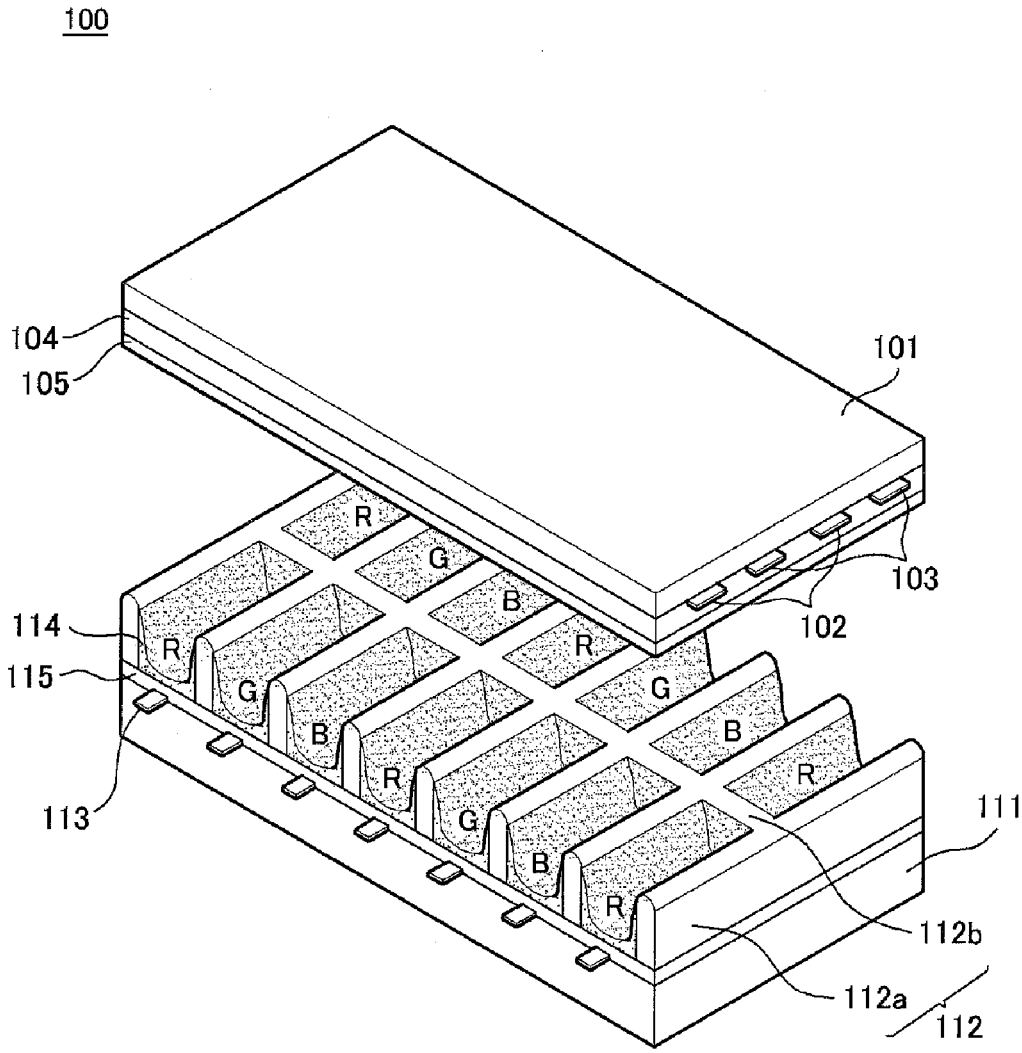
FIG. 1 illustrates a structure of a plasma display panel according to an exemplary embodiment.

FIG. 1 illustrates a structure of a plasma display panel according to an exemplary embodiment.

As shown in FIG. 1, a plasma display panel 100 according to an exemplary embodiment includes a front substrate 101, on which a scan electrode 102 and a sustain electrode 103 are positioned parallel to each other, and a rear substrate 111 on which an address electrode 113 is positioned to intersect the scan electrode 102 and the sustain electrode 103. The front substrate 101 and the rear substrate 111 coalesce with each other by a seal layer (not show) to be opposite to each other.

An upper dielectric layer 104 is positioned on the scan electrode 102 and the sustain electrode 103 to provide electrical insulation between the scan electrode 102 and the sustain electrode 103.

A protective layer 105 is positioned on the upper dielectric layer 104 to facilitate discharge conditions. The protective layer 105 may include a material having a high secondary electron emission coefficient, for example, magnesium oxide (MgO).

A lower dielectric layer 115 is positioned on the address electrode 113 to provide electrical insulation of the address electrodes 113.

Barrier ribs 112 of a stripe type, a well type, a delta type, a honeycomb type, and the like, are positioned on the lower dielectric layer 115 to partition discharge spaces (i.e., discharge cells). A red (R) discharge cell, a green (G) discharge cell, and a blue (B) discharge cell, and the like, may be positioned between the front substrate 101 and the rear substrate 111. In addition to the red (R), green (G), and blue (B) discharge cells, a white (W) discharge cell or a yellow (Y) discharge cell may be further positioned.

Each discharge cell partitioned by the barrier ribs 112 is filled with a discharge gas including xenon (Xe), neon (Ne), and the like.

A phosphor layer 114 is positioned inside the discharge cells to emit visible light for an image display during an address discharge. For instance, first, second and third phosphor layer respectively emitting red (R), blue (B) and green (G) light may be positioned inside the discharge cells. In addition to the red (R), green (G) and blue (B) light, a phosphor layer emitting white or yellow light may be further positioned.

A thickness of at least one of the phosphor layers 114 formed inside the red (R), green (G) and blue (B) discharge cells may be different from thicknesses of the other phosphor layers. For instance, thicknesses of the second and third phosphor layers inside the blue (B) and green (G) discharge cells may be larger than a thickness of the first phosphor layer inside the red (R) discharge cell. The thickness of the second phosphor layer may be substantially equal or different from the thickness of the third phosphor layer.

Widths of the red (R), green (G), and blue (B) discharge cells may be substantially equal to one another. Further, a width of at least one of the red (R), green (G), or blue (B) discharge cells may be different from widths of the other discharge cells. For instance, a width of the red (R) discharge cell may be the smallest, and widths of the green (G) and blue (B) discharge cells may be larger than the width of the red (R) discharge cell. The width of the green (G) discharge cell may be substantially equal or different from the width of the blue (B) discharge cell. Hence, a color temperature of an image displayed on the plasma display panel can be improved.

The plasma display panel 100 may have various forms of barrier rib structures as well as a structure of the barrier rib 112 shown in FIG. 1. For instance, the barrier rib 112 includes a first barrier rib 112*b* and a second barrier rib 112*a*. The barrier rib 112 may have a differential type barrier rib structure in which heights of the first and second barrier ribs 112*b* and 112*a* are different from each other.

In the differential type barrier rib structure, a height of the first barrier rib 112*b* may be smaller than a height of the second barrier rib 112*a*.

While FIG. 1 has been illustrated and described the case where the red (R), green (G) and blue (B) discharge cells are arranged on the same line, the red (R), green (G) and blue (B) discharge cells may be arranged in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

While FIG. 1 has illustrated and described the case where the barrier rib 112 is formed on the rear substrate 111, the barrier rib 112 may be formed on at least one of the front substrate 101 or the rear substrate 111.

In FIG. 1, the upper dielectric layer 104 and the lower dielectric layer 115 each have a single-layered structure. However, at least one of the upper dielectric layer 104 or the lower dielectric layer 115 may have a multi-layered structure.

While the address electrode 113 positioned on the rear substrate 111 may have a substantially constant width or thickness, a width or thickness of the address electrode 113 inside the discharge cell may be different from a width or thickness of the address electrode 113 outside the discharge cell. For instance, a width or thickness of the address electrode 113 inside the discharge cell may be larger than a width or thickness of the address electrode 113 outside the discharge cell.

Figure 2:
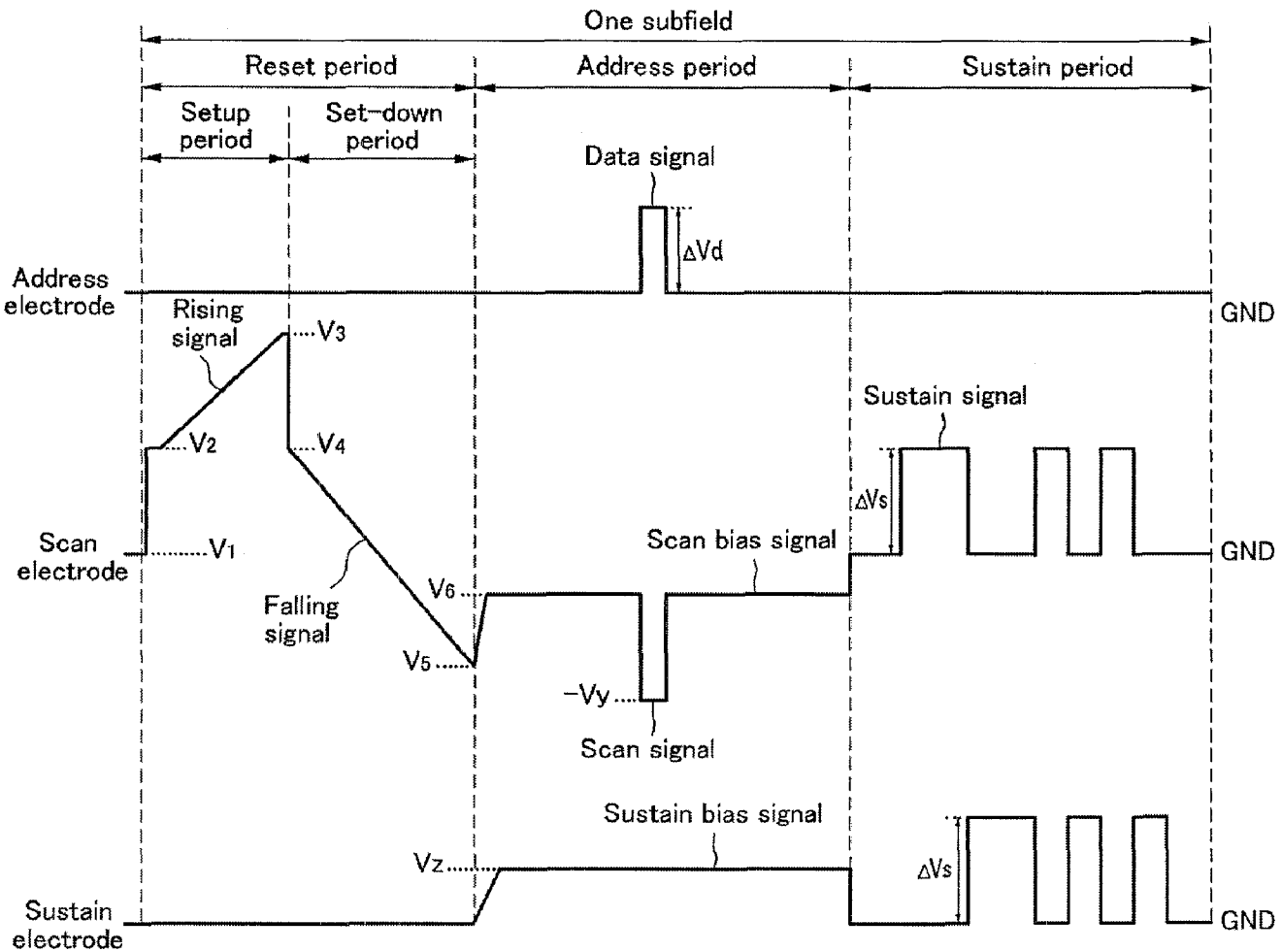
FIG. 2 illustrates an example of an operation of the plasma display panel according to the exemplary embodiment.

FIG. 2 illustrates an example of an operation of the plasma display panel according to the exemplary embodiment. The exemplary embodiment is not limited to FIG. 2, and the plasma display can be operated in various manners.

As shown in FIG. 2, during a reset period for initialization, a reset signal is supplied to the scan electrode. The reset signal includes a rising signal and a falling signal. The reset period is further divided into a setup period and a set-down period.

The rising signal is supplied to the scan electrode during the setup period, thereby generating a weak dark discharge (i.e., a setup discharge) inside the discharge cell during the setup period. Hence, a proper amount of wall charges are accumulated inside the discharge cell.

The falling signal is supplied to the scan electrode during the set-down period, thereby generating a weak erase discharge (i.e., a set-down discharge) inside the discharge cell. Hence, the remaining wall charges are uniform inside the discharge cells to the extent that an address discharge occurs stably.

During an address period following the reset period, a scan bias signal, which is substantially maintained at a sixth voltage V6 higher than a lowest voltage V5 of the falling signal, is supplied to the scan electrode.

A scan signal falling from the scan bias signal is supplied to the scan electrode.

A width of a scan signal supplied during an address period of at least one subfield may be different from widths of scan signals supplied during address periods of the other subfields. A width of a scan signal in a subfield may be larger than a width of a scan signal in a next subfield in time order. For instance, a width of the scan signal may be gradually reduced in the order of 2.6 μs, 2.3 μs, 2.1 μs, 1.9 μs, etc., or may be reduced in the order of 2.6 μs, 2.3 μs, 2.3 μs, 2.1 μs, 1.9 μS, 1.9 μs, etc, in the successively arranged subfields.

As above, when the scan signal is supplied to the scan electrode, a data signal corresponding to the scan signal is supplied to the address electrode.

As the voltage difference between the scan signal and the data signal is added to the wall voltage produced during the reset period, the address discharge occurs inside the discharge cell to which the data signal is supplied.

A sustain bias signal is supplied to the sustain electrode during the address period so as to prevent the generation of unstable address discharge by interference of the sustain electrode.

The sustain bias signal is substantially maintained at a sustain bias voltage Vz. The sustain bias voltage Vz is lower than a voltage Vs of a sustain signal and is higher than a ground level voltage GND.

During a sustain period following the address period, the sustain signal may be supplied to at least one of the scan electrode or the sustain electrode. For instance, the sustain signal is alternately supplied to the scan electrode and the sustain electrode.

As the wall voltage inside the discharge cell selected by performing the address discharge is added to the sustain voltage Vs of the sustain signal, every time the sustain signal is supplied, a sustain discharge, i.e., a display discharge occurs between the scan electrode and the sustain electrode.

A plurality of sustain signals are supplied during a sustain period of at least one subfield, and a width of at least one of the plurality of sustain signals may be different from widths of the other sustain signals. For instance, a width of a first supplied sustain signal among the plurality of sustain signals may be larger than widths of the other sustain signals. Hence, a sustain discharge can more stably occur.

Figure 3A:
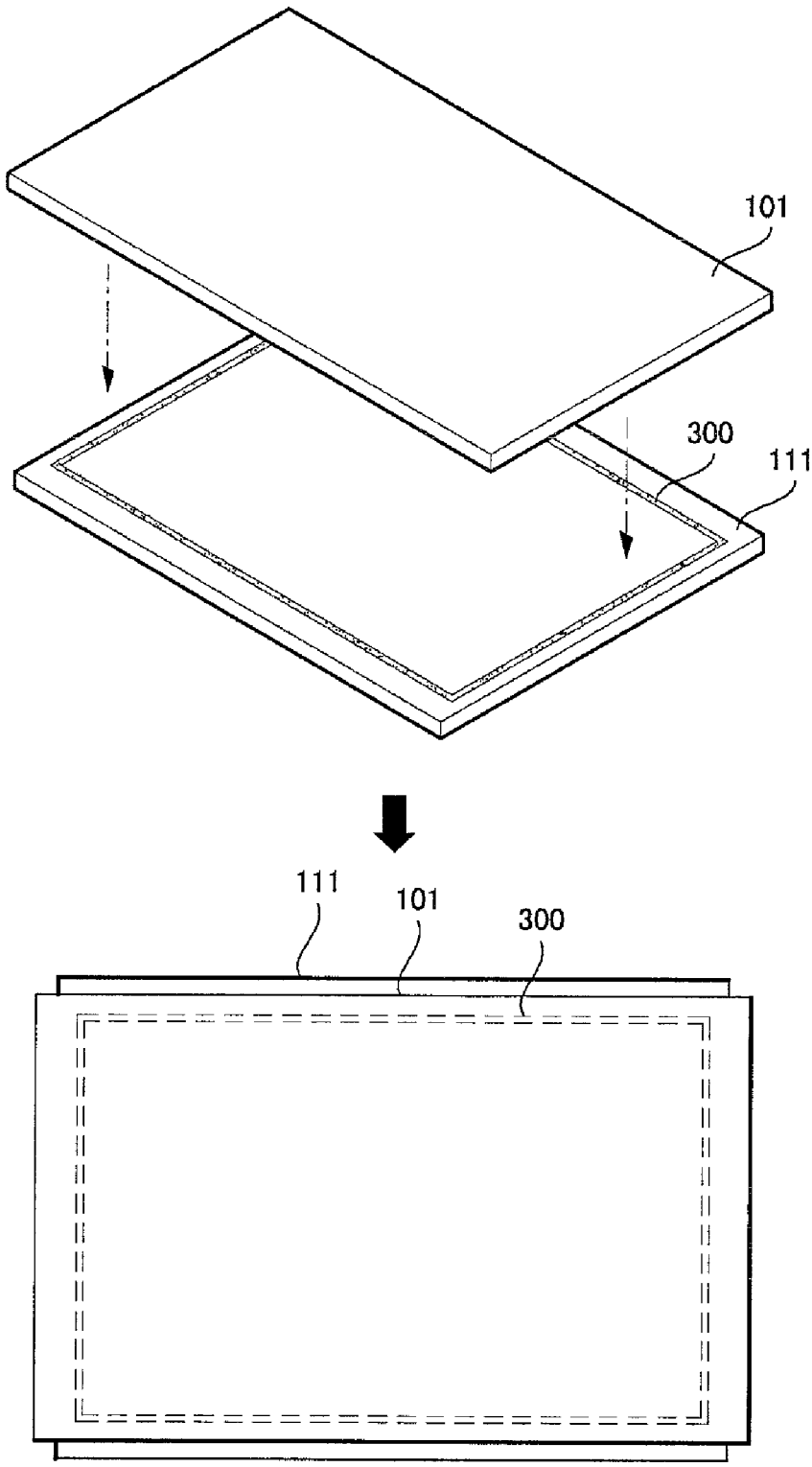
FIGS. 3A and 3B illustrate an example of a method of manufacturing the plasma display panel.
Figure 3B:
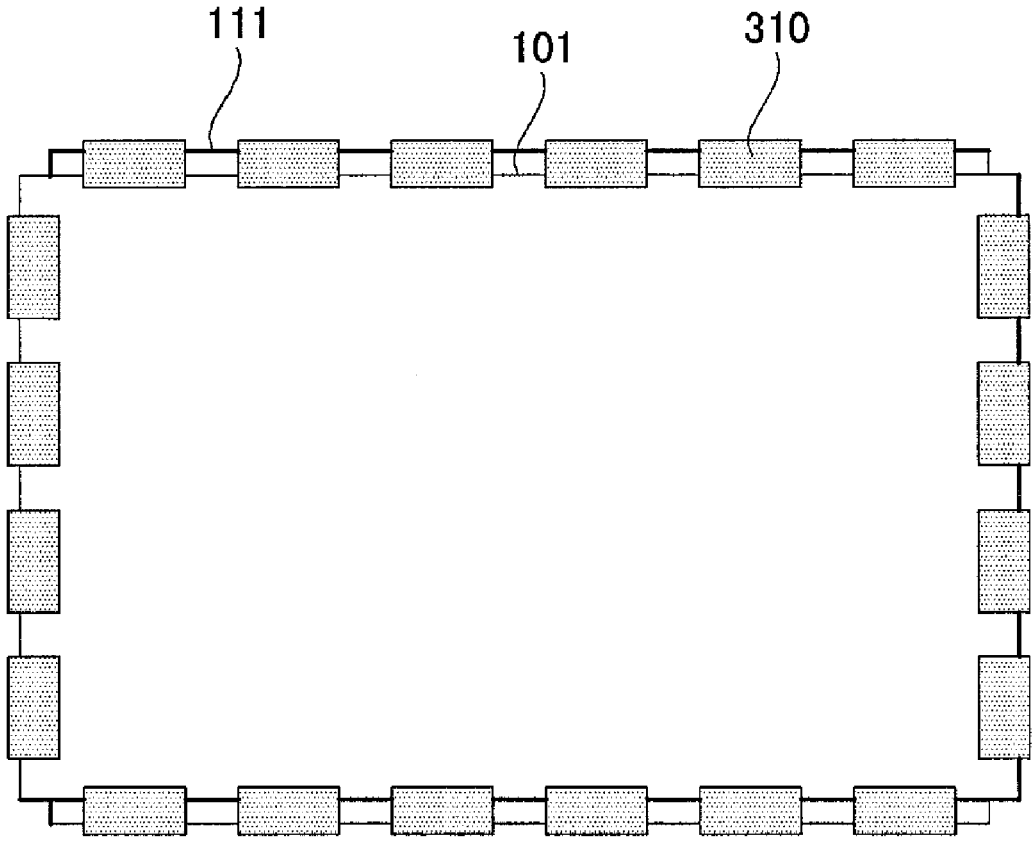

FIGS. 3A and 3B illustrate an example of a method of manufacturing the plasma display panel.

As shown in FIG. 3A, a seal layer 300 is formed at an edge of at least one of the front substrate 101 or the rear substrate 111, and the front substrate 101 and the rear substrate 111 coalesce with each other using the seal layer 300. For instance, the seal layer 300 is formed in a dummy area of the rear substrate 111, and it is possible that the front substrate 101 and the rear substrate 111 coalesce with each other by applying a pressure to the front substrate 101 and the rear substrate 111 to complete a coalescing structure.

As shown in FIG. 3B, a fixing device 310 such as a clip is disposed at an edge of the coalescing structure. The fixing device 310 fix the coalescing structure so that the front substrate 101 and the rear substrate 111 are aligned with each other until the seal layer 300 is hardened.

Figure 4A:
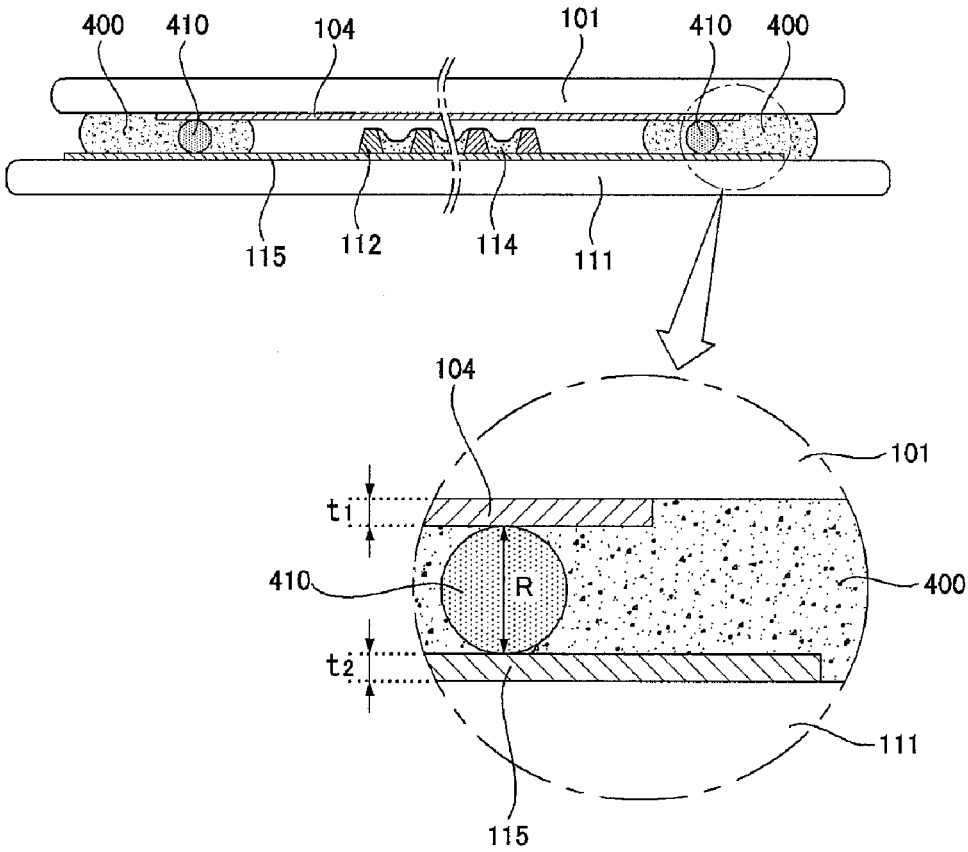
FIGS. 4A and 4B are diagrams for explaining a seal layer.
Figure 4B:
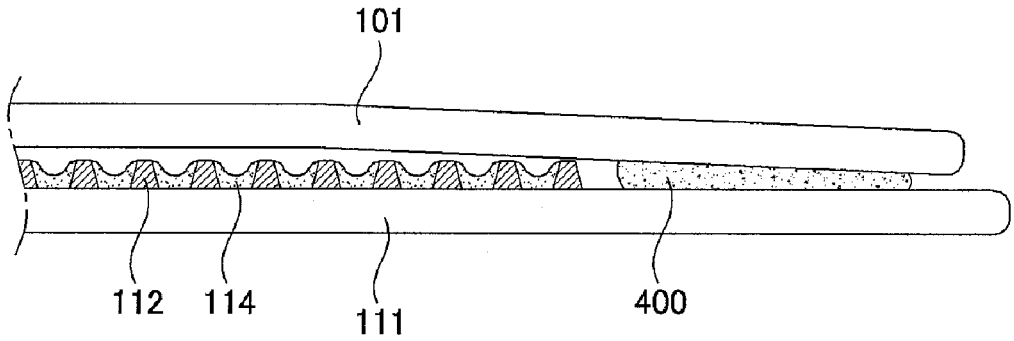

FIGS. 4A and 4B are diagrams for explaining a seal layer. Hereinafter, the illustration and the description of the protective layer are omitted.

As shown in FIG. 4A, a seal layer 400 of the plasma display panel 100 includes beads 410.

The bead 410 can properly maintain an interval between the front substrate 101 and the rear substrate 111, thereby preventing a collision of the front substrate 101 and the rear substrate 111 during the drive. Hence, a noise can be reduced.

In case that there is no bead 410, the seal layer 400, as shown in FIG. 4B, may be excessively compressed by a fixing device such as a clip used to align the front substrate 101 and the rear substrate 111 in a coalescing process of the front substrate 101 and the rear substrate 111. Hence, an interval between the front substrate 101 and the rear substrate 111 may be nonuniform.

In case that there is no bead 410, the front substrate 101 and the rear substrate 111 can be aligned by disposing the fixing device at the edge of the coalescing structure as shown in FIG. 3B. However, the seal layer 400 may be excessively compressed as shown in FIG. 4B because the fixing device applies the pressure to the edge of the coalescing structure., Hence, the interval between the front substrate 101 and the rear substrate 111 may be nonuniform. Further, the front substrate 101 collides with the barrier rib 112 due to the nonuniform interval, and thus a noise may be excessively generated.

On the other hand, as shown in FIG. 4A, when the seal layer 400 includes the bead 410, the bead 410 supports the front substrate 101 and the rear substrate 111 to prevent the excessive compression of the seal layer 400. Hence, a thickness of the seal layer 400 can be kept constant. Further, the collision of the front substrate 101 and the barrier rib can be sufficiently prevented and the noise can be prevented.

An example of a method of manufacturing the seal layer 400 will be described below.

First, a seal material, a solvent, a binder and the bead 410 are mixed to form a seal paste having the fluidity.

Afterwards, the seal paste is coated on a dummy area of at least one of the front substrate 101 or the rear substrate 111 to attach the front substrate 101 to the rear substrate 111.

A process for firing the seal paste is performed in a firing furnace to melt the seal material of the seal paste coated between the front substrate 101 and the rear substrate 111 and to burn the binder and the solvent. Hence, the seal layer 400 is formed.

If the bead 410 mixed with the seal material is melted in the firing process of the seal paste, it is difficult to properly maintain the interval between the front substrate 101 and the rear substrate 111. Accordingly, it may be preferable not to melt the bead 410 in the firing process. A melting point of the bead 410 may be higher than a melting point of the seal material. The melting point of the bead 410 may be equal to or higher 500° C.

A material of the bead 410 is not particularly limited except that the bead 410 is not melted in the firing process of the seal paste. The material of the bead 410 may be metal, plastic, glass, silicon, and the like.

The bead 410 may be randomly distributed inside the seal layer 400. A large amount of beads 410 may be disposed between the upper dielectric layer 104 and the lower dielectric layer 115.

In FIG. 4A, R indicates a size of the bead 410, t1 a thickness of the upper dielectric layer 104, and t2 a thickness of the lower dielectric layer 115.

FIGS. 5A to 5D are diagrams for explaining a relationship between a bead and a thickness of an upper dielectric layer.

Figure 5A:
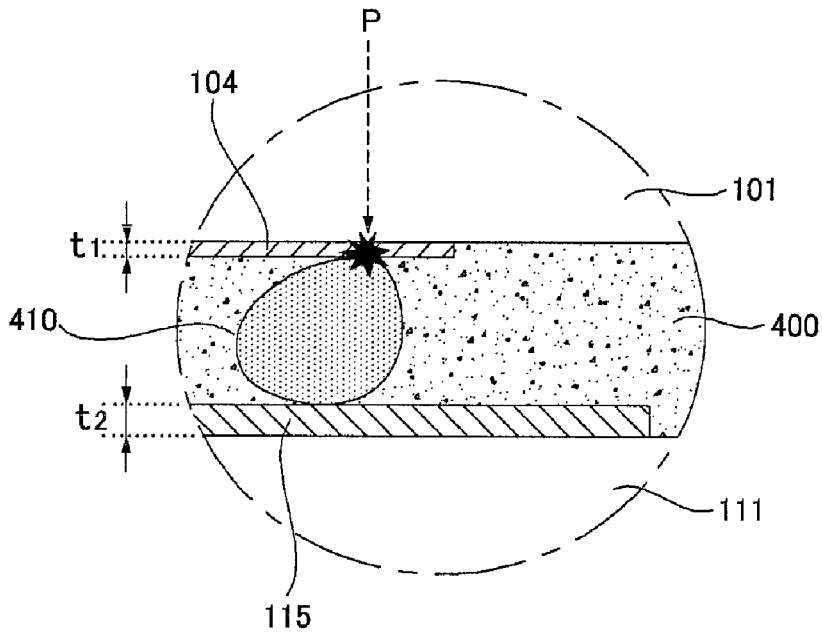

As shown in FIG. 5A, the bead 410 is disposed between the upper dielectric layer 104 and the lower dielectric layer 115.

The bead 410 supports the front substrate 101 and the rear substrate 111 so as to properly maintain the interval between the front substrate 101 and the rear substrate 111 when the front substrate 101 and the rear substrate 111 coalesce. The upper dielectric layer 104 serves as a buffer capable of preventing a damage of the front substrate 101 caused by the bead 410. The lower dielectric layer 115 serves as a buffer capable of preventing a damage of the rear substrate 111 caused by the bead 410.

A pressure may be concentratedly applied to a specific portion of the upper dielectric layer 104 due to the bead 410. For instance, since the bead 410 supports the front substrate 101 and the rear substrate 111, a pressure due to the weight of the front substrate 101 may be concentratedly applied to a position P. If the front substrate 101 is excessively thin, the upper dielectric layer 104 may be physically damaged by the pressure concentratedly applied to the position P. This may be equally applied to the lower dielectric layer 115.

Figure 5B:
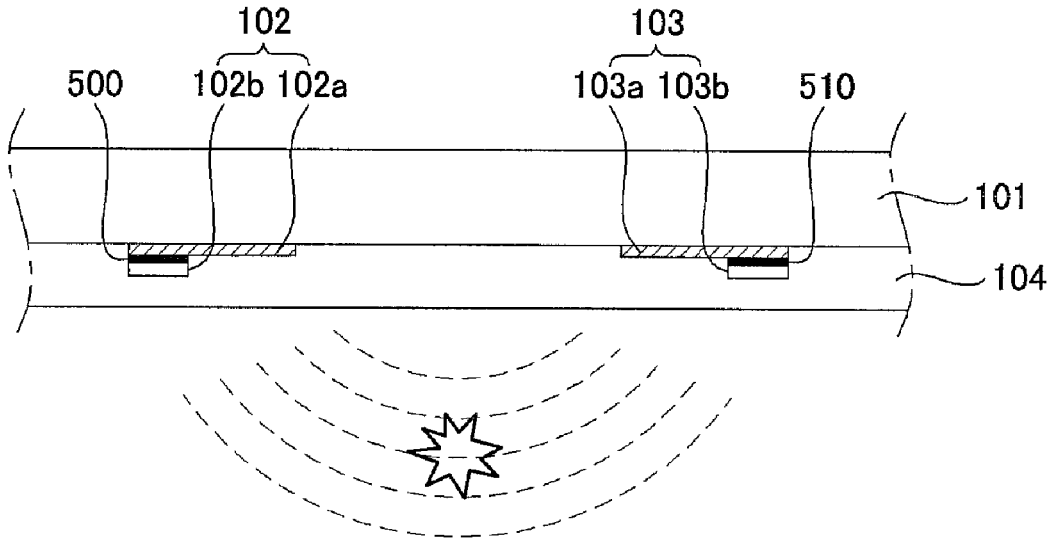

As shown in FIG. 5B, since the scan electrode 102 and the sustain electrode 103 are disposed on the same layer, a firing voltage between the scan electrode 102 and the sustain electrode 103 is relatively high.

In case that the upper dielectric layer 104 is physically damaged by the bead 410, a driving signal with a high voltage is necessary to generate a discharge between the scan electrode 102 and the sustain electrode 103. A dielectric breakdown of the upper dielectric layer 104 may occur by the driving signal with the high voltage.

In FIG. 5B, the scan electrode 102 and the sustain electrode 103 each have a multi-layered structure. For instance, each of the scan electrode 102 and the sustain electrode 103 may include transparent electrodes 102*a* and 103*a* and bus electrodes 102*b* and 103*b*. Black layers 500 and 510 may be further positioned between the transparent electrodes 102*a* and 103*a* and the bus electrodes 102*b* and 103*b*

FIG. 5C is a table indicating whether a dielectric breakdown of the upper dielectric layer occurs or not at each voltage of 192V, 242V, 360V and 485V applied to the scan electrode while a ratio t1/R of the thickness t1 of the upper dielectric layer to the size R of the bead ranges from 0.1 to 0.47. The bead having the size R of about 145 μm is used.

In FIG. 5C, ○ indicates that the dielectric breakdown of the upper dielectric layer did not occur, and X indicates that the dielectric breakdown of the upper dielectric layer occurred.

When the ratio t1/R is 0.1, the dielectric breakdown of the upper dielectric layer occurred at 242V, 360V and 485V except 192V. In this case, because the thickness t1 of the upper dielectric layer is excessively small, the upper dielectric layer may be easily damaged by the bead. Accordingly, it is difficult that the upper dielectric layer bears a relatively low voltage of 242V.

On the contrary, when the ratio t1/R is 0.125, the dielectric breakdown of the upper dielectric layer occurred at only a high voltage of 485V and the dielectric breakdown of the upper dielectric layer did not occur at 192V, 242V and 360V.

Since it is a rare case to apply a high voltage of 485V to the scan electrode during the drive of the plasma display panel, the reliability of the plasma display panel can be secured to some extent when the ratio t1/R is 0.125.

When the ratio t1/R is equal to or more than 0.13, the dielectric breakdown of the upper dielectric layer did not occur at a high voltage of 485V.

Figures 5D, 6A:
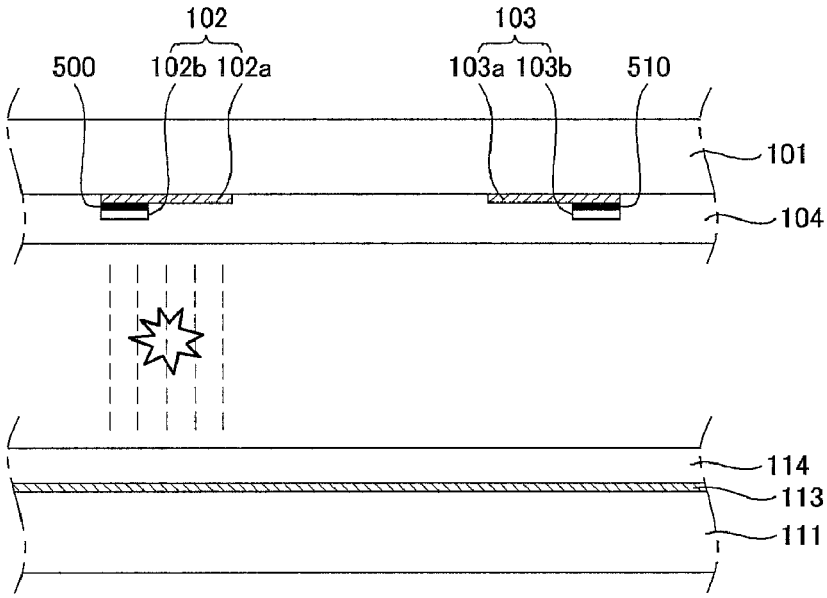

FIG. 5D is a table indicating a drive efficiency while the ratio t1/R ranges from 0.1 to 0.47. In FIG. 5D, ◎ indicates that the drive efficiency is excellent, ⊚ indicates that the drive efficiency is good, and X indicates that the drive efficiency is bad.

When the ratio t1/R ranges from 0.1 to 0.35, a discharge can occur between the scan electrode and the sustain electrode at a relatively low voltage because the thickness t1 of the upper dielectric layer is sufficiently small. Hence, the drive efficiency is excellent.

When the ratio t1/R ranges from 0.38 to 0.42, the drive efficiency is good because the thickness t1 of the upper dielectric layer is proper.

On the contrary, when the ratio t1/R is equal to or more than 0.46, a discharge can occur between the scan electrode and the sustain electrode at a relatively high voltage because the thickness t1 of the upper dielectric layer may be excessively large. In this case, because a firing voltage between the scan electrode and the sustain electrode is excessively high, the drive efficiency is bad.

Considering the description of FIGS. 5A to 5D, the ratio t1/R may range from 0.125 to 0.42. Further, the ratio t1/R may range from 0.13 to 0.35. Hence, when the seal layer includes the bead, the reliability of the plasma display panel can be improved by preventing the dielectric breakdown of the upper dielectric layer, and a reduction in the drive efficiency can be prevented by reducing the firing voltage between the scan electrode and the sustain electrode.

FIGS. 6A to 6C are diagrams for explaining a relationship between a bead and a thickness of a lower dielectric layer.

As shown in FIG. 6A, because the scan electrode 102 on the front substrate 101 and the address electrode 113 on the rear substrate 111 are positioned to be opposite to each other, a firing voltage between the scan electrode 102 and the address electrode 113 may be lower than the firing voltage between the scan electrode 102 and the sustain electrode 103.

Accordingly, a lower voltage than a voltage applied to the scan electrode 102 or the sustain electrode 103 may be applied to the address electrode 113. Further, the thickness t2 of the lower dielectric layer 115 providing insulation of the address electrode 113 may be smaller than the thickness t1 of the upper dielectric layer 104 providing insulation of the scan electrode 102 and the sustain electrode 103.

FIG. 6B is a table indicating whether a dielectric breakdown of the lower dielectric layer occurs or not at each voltage of 192V, 235V, 320V and 452V applied to the address electrode while a ratio t2/R of the thickness t2 of the lower dielectric layer to the size R of the bead ranges from 0.03 to 0.21. The bead having the size R of about 145 μm is used.

In FIG. 6B, ◎ indicates that the dielectric breakdown of the lower dielectric layer did not occur, and X indicates that the dielectric breakdown of the lower dielectric layer occurred.

When the ratio t2/R is 0.03, the dielectric breakdown of the lower dielectric layer occurred at 235V, 320V and 452V except 192V. In this case, because the thickness t2 of the lower dielectric layer is excessively small, the lower dielectric layer may be easily damaged by the bead. Accordingly, it is difficult that the lower dielectric layer bears a relatively low voltage of 235V.

On the contrary, when the ratio t2/R is 0.05, the dielectric breakdown of the lower dielectric layer occurred at only a high voltage of 452V and the dielectric breakdown of the lower dielectric layer did not occur at 192V, 235V and 320V.

Since it is a rare case to apply a high voltage of 452V to the address electrode during the driver of the panel, the reliability of the plasma display panel can be secured to some extent when the ratio t2/R is 0.05.

When the ratio t2/R is equal to or more than 0.055, the dielectric breakdown of the lower dielectric layer did not occur at a high voltage of 452V.

FIG. 6C is a table indicating a drive efficiency while the ratio t2/R ranges from 0.03 to 0.21. In FIG. 6C, ◎ indicates that the drive efficiency is excellent, ⊚ indicates that the drive efficiency is good, and X indicates that the drive efficiency is bad.

When the ratio t2/R ranges from 0.03 to 0.14, a discharge can sufficiently occur between the scan electrode and the address electrode at a relatively low voltage because the thickness t2 of the lower dielectric layer is sufficiently small. Hence, the drive efficiency is excellent.

When the ratio t2/R ranges from 0.15 to 0.17, the drive efficiency is good because the thickness t2 of the lower dielectric layer is proper.

On the contrary, when the ratio t2/R is equal to or more than 0.20, a discharge can occur between the scan electrode and the address electrode at a relatively high voltage because the thickness t2 of the lower dielectric layer may be excessively large. In this case, because a firing voltage between the scan electrode and the address electrode is excessively high, the drive efficiency is bad.

Considering the description of FIGS. 6A to 6C, the ratio t2/R may range from 0.05 to 0.17. Further, the ratio t2/R may range from 0.055 to 0.14. Hence, when the seal layer includes the bead, the reliability of the plasma display panel can be improved by preventing the dielectric breakdown of the lower dielectric layer, and a reduction in the drive efficiency can be prevented by reducing the firing voltage between the scan electrode and the address electrode.

Figure 7A:
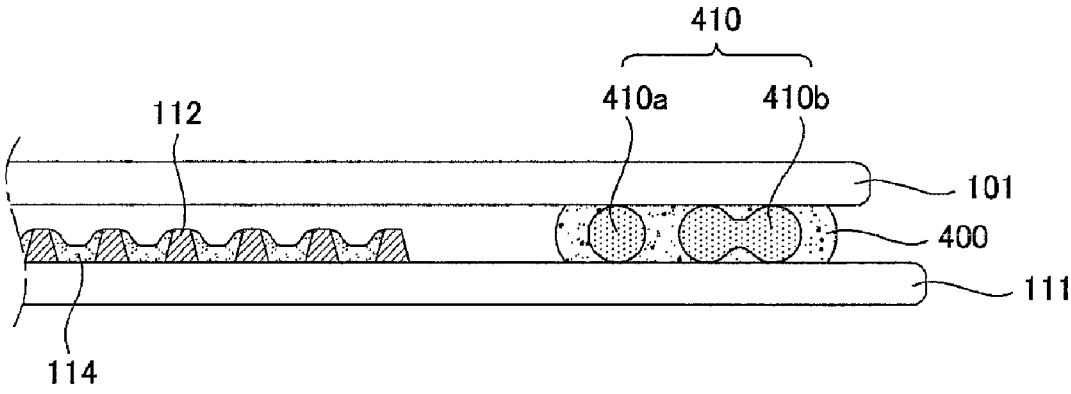
FIGS. 7A and 7B are diagrams for explaining a double egg bead.
Figure 7B:
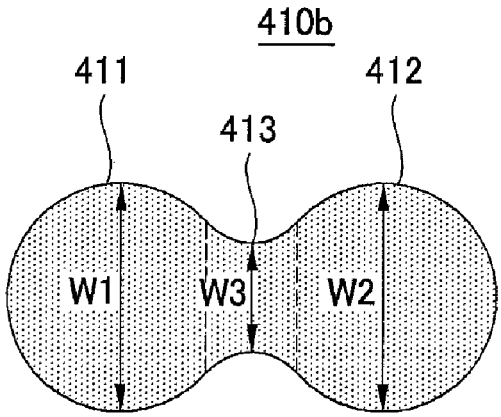

FIGS. 7A and 7B are diagrams for explaining a double egg bead.

As shown in FIG. 7A, at least one of the plurality of beads 410 may have a form connecting at least two beads of the same shape or different shapes to each other. For instance, the bead 410 may include a 1-typed of a first bead 410*a* and a 2-typed of a second bead 410*b*. The second bead 410*b*, for instance, may have a dumbbell shape connecting two beads.

The second bead 410*b*, as shown in FIG. 7B, may include a head portion 411, a body portion 412 and a connection portion 413 whose the size is smaller than the size of the head portion 411 and the body portion 412. The connection portion 413 connects the head portion 411 to the body portion 412. In other words, the second bead 410*b* is a form connecting two beads (i.e., the head portion 411 and the body portion 412) of the same shape or different shapes by the connection portion 413.

A section width W3 of the connection portion 413 may be smaller than a section width W1 of the head portion 411 and a section width W2 of the body portion 412. A volume of the connection portion 413 may be smaller than a volume of each of the head portion 411 and the body portion 412.

As above, a bead (for instance, the second bead 410*b*) having a form connecting at least two beads to each other is referred to as a double egg bead.

Figure 8A:
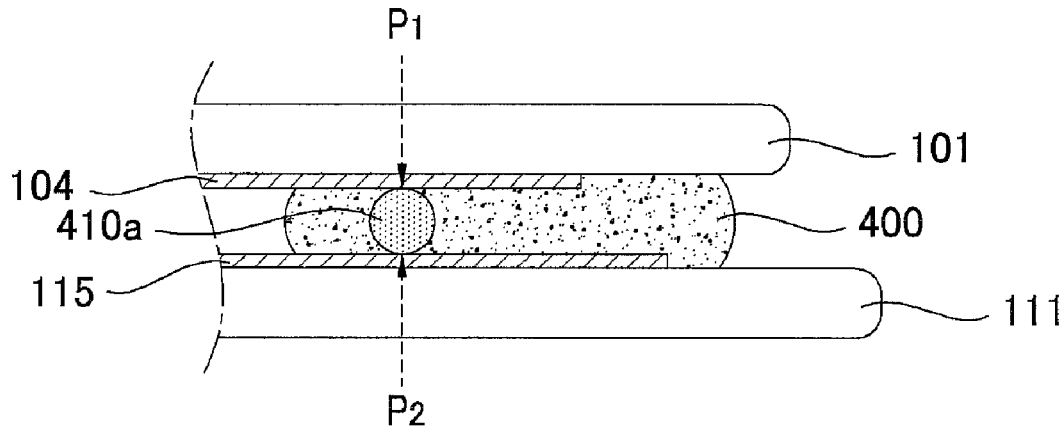
FIGS. 8A and 8B are diagrams for explaining an effect of a double egg bead.
Figure 8B:
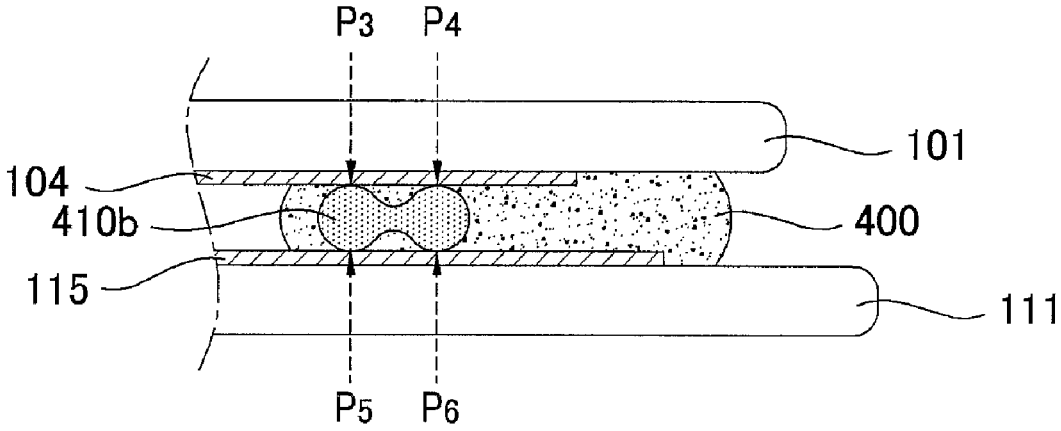

FIGS. 8A and 8B are diagrams for explaining an effect of a double egg bead.

In FIG. 8A, the seal layer 400 includes a single egg bead 410*a* such as the 1-typed of the first bead of FIG. 8A, and does not include a double egg bead.

The single egg bead 410*a* is positioned between the upper dielectric layer 104 and the lower dielectric layer 115, and supports the front substrate 101 and the rear substrate 111. In this case, since a pressure is concentratedly applied to positions P1 and P2 of the front substrate 101 and the rear substrate 111, there is a great likelihood that the upper dielectric layer 104 at the position P1 or the lower dielectric layer 115 at the position P2 is physically damaged.

On the contrary, as shown in FIG. 8B, in case that the seal layer 400 includes a double egg bead 410*b*, a pressure applied to the front substrate 101 and the rear substrate 111 may be dispersed into positions P3, P4, P5 and P6. There is a small likelihood that the upper dielectric layer 104 and the lower dielectric layer 115 are physically damaged. Further, a support force between the front substrate 101 and the rear substrate 11 can be improved. Supposing that two beads included in the double egg bead 410*b* have the same size.

Figure 9:
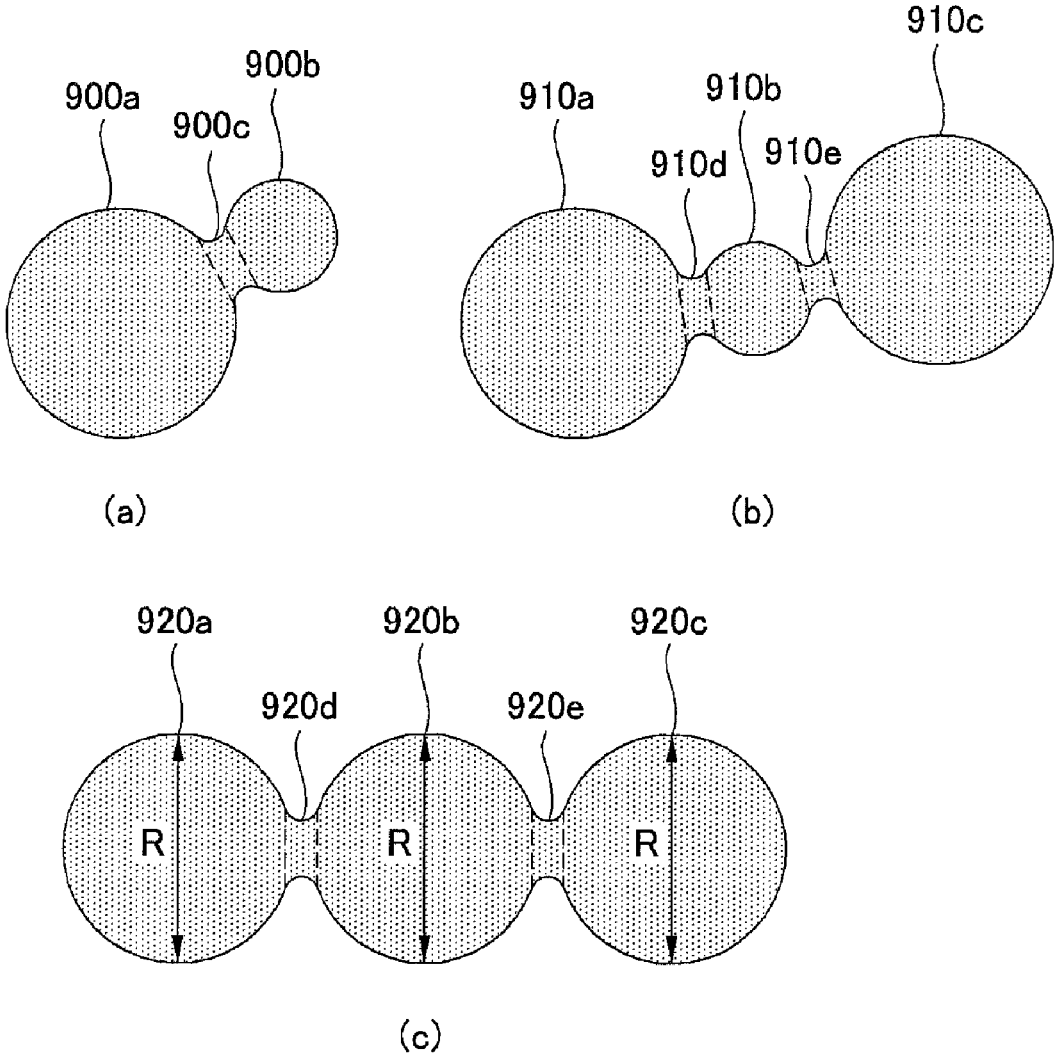
FIG. 9 illustrates another form of a double egg bead.

FIG. 9 illustrates another form of a double egg bead.

In FIG. 9, (a) shows a double egg bead connecting two different beads 900*a* and 900*b* using a connection portion 900*c* whose the size is smaller than the size of the beads 900*a* and 900*b*; (b) shows a double egg bead connecting three beads 910*a*, 910*b* and 910*c* using two connection portions 910*d* and 910*e*; and (c) shows a double egg bead connecting three beads 920*a*, 920*b* and 920*c* using two connection portions 920*d* and 920*e*, wherein the three beads 920*a*, 920*b* and 920*c* have the same size.

The form of the double egg bead is not limited to the form shown in FIG. 9, and may be changed variously. For instance, a double egg bead connecting four beads to each other is possible.

Figure 10A:
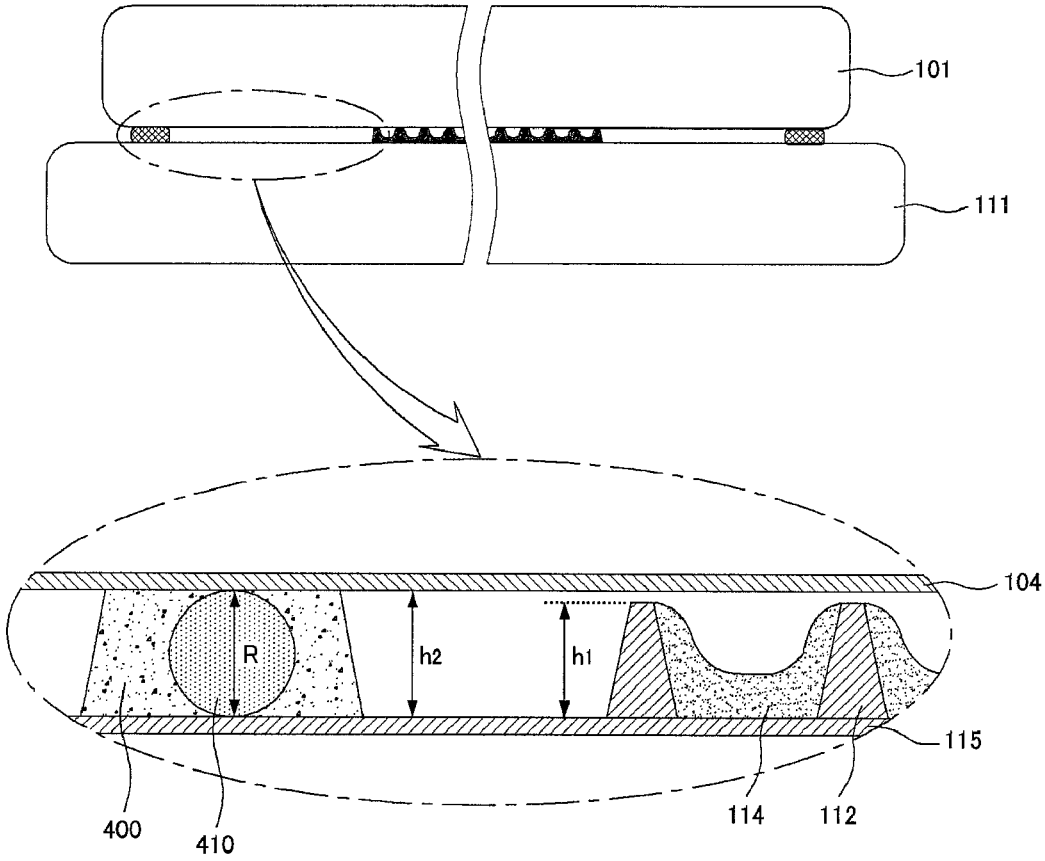
FIGS. 10A to 10C are diagrams for explaining a height of a seal layer and a size of a bead.
Figure 10B:
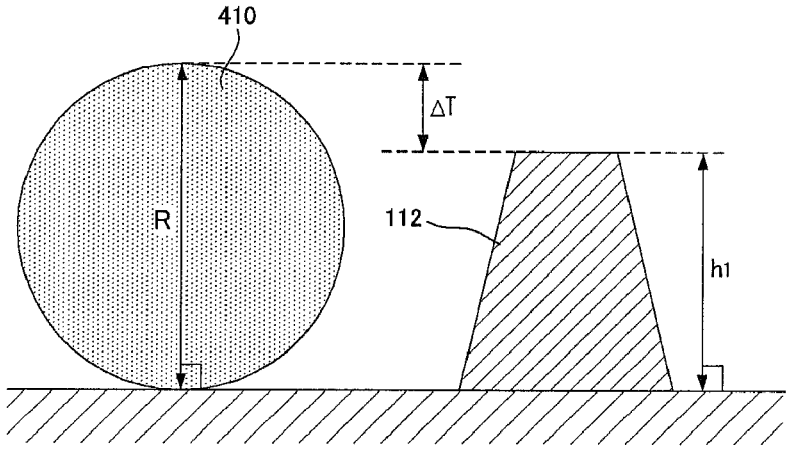
Figure 10C:
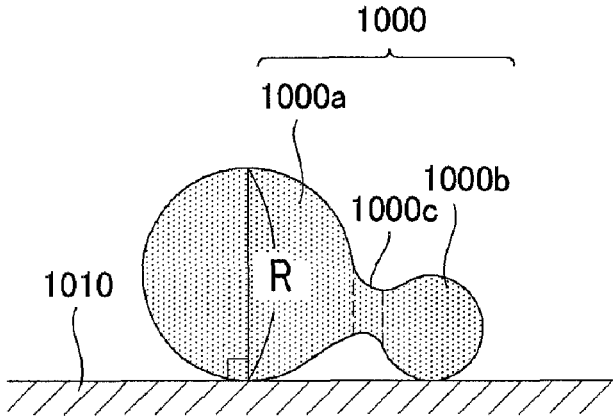

FIGS. 10A to 10C are diagrams for explaining a height of a seal layer and a size of a bead.

As shown in FIGS. 10A to 10C, the seal layer 400 is positioned between the front substrate 101 and the rear substrate 111 at edges of the substrates 101 and 111 to attach the front substrate 101 to the rear substrate 111. A height h2 of the seal layer 400 may be larger than a height h1 of the barrier rib 112. Therefore, the barrier rib 112 does not contact the upper dielectric layer 104, and is spaced apart from the upper dielectric layer 104 at a predetermined distance.

The bead 410 of the seal layer 400 properly maintains an interval between the front substrate 101 and the rear substrate 111. Therefore, the interval between the front substrate 101 and the rear substrate 111 may be determined by a size of the bead 410. For instance, supposing that a size R of the bead 410 is 200 μm, the interval between the front substrate 101 and the rear substrate 111 may be equal to or larger than 200 μm.

The size R of the bead 410, as shown in FIG. 10B, may be larger than the height h1 of the barrier rib 112 by a magnitude of ΔT so that the height h2 of the seal layer 400 is larger than the height h1 of the barrier rib 112.

As shown in FIG. 10C, when a double egg bead 1000 including a head portion 1000*a*, a body portion 1000*b* and a connection portion 1000*c* is placed on a horizontal surface 1010, a maximum height of the double egg bead 1000 in a direction perpendicular to the horizontal surface 1010 may be referred to as a size R of the double egg bead 1000.

If a thickness of the protective layer (not shown) is neglected in FIG. 10A, an interval between the upper dielectric layer 104 and the lower dielectric layer 115 may be substantially equal to a size R of the bead 410.

Figure 11:
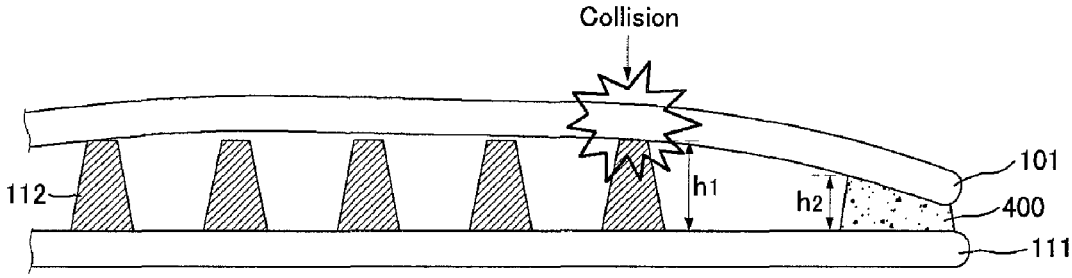
FIG. 11 is a diagram for explaining a reason why a height of a seal layer is larger than a height of a barrier rib.

FIG. 11 is a diagram for explaining a reason why a height of a seal layer is larger than a height of a barrier rib.

In FIG. 11, a height h1 of the barrier rib 112 is larger than a height h2 of the seal layer 400. In this case, although it is not shown, the size of the bead included in the seal layer 400 is smaller than the height h1 of the barrier rib 112.

Accordingly, since the height h2 of the seal layer 400 is smaller than the height h1 of the barrier rib 112 by a pressure applied by a fixing device such as a clip, the front substrate 101 may frequently collide with the barrier rib 112 during the drive of the plasma display panel. Hence, the generation of noise may increase.

On the other hand, when as shown in FIGS. 10A and 10B, the size R of the bead 410 is higher than the height h1 of the barrier rib 112 and the height h2 of the seal layer 400 is larger than the height h1 of the barrier rib 112, the collision of the front substrate 101 and the barrier rib 112 can be prevented and the generation of noise can decrease.

Figure 12:
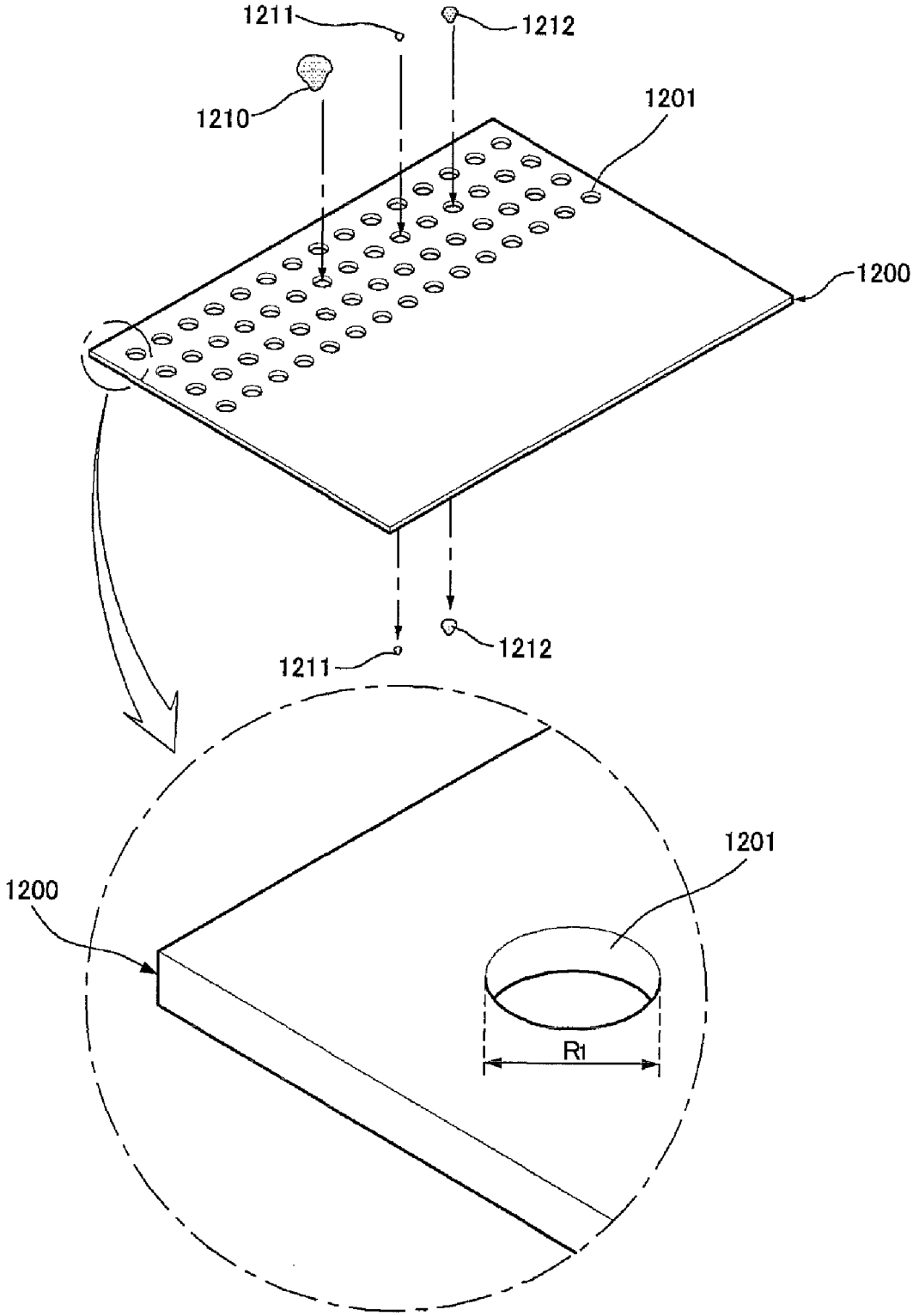
FIG. 12 is a diagram for explaining a method of manufacturing a bead.

FIG. 12 is a diagram for explaining a method of manufacturing a bead. FIGS. 13A to 13D are diagrams for explaining a shape of a bead and a location of the bead inside a seal layer.

First, as shown in FIG. 12, a filter unit 1200 including a plurality of holes 1201 performs a filtering operation on beads 1210, 1211 and 1212 manufactured through predetermined processes. A diameter of the hole 1201 may be R1.

More specifically, the beads 1210, 1211 and 1212 are placed on the filter unit 1200. Then, the beads 1211 and 1212 having a size smaller than the diameter R1 of the hole 1201 may pass through the filter unit 1200, and the bead 1210 having a size larger than the diameter R1 of the hole 1201 may not pass through the filter unit 1200.

The beads 1211 and 1212 going through the filtering process are mixed with the seal material to form the seal layer.

Figure 13A:
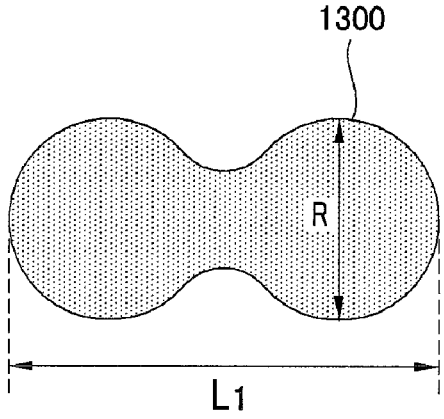
FIGS. 13A to 13D are diagrams for explaining a shape of a bead and a location of the bead inside a seal layer.

FIG. 13A shows a double egg bead 1300 having a size of R and a length of L1.

Figure 13B:
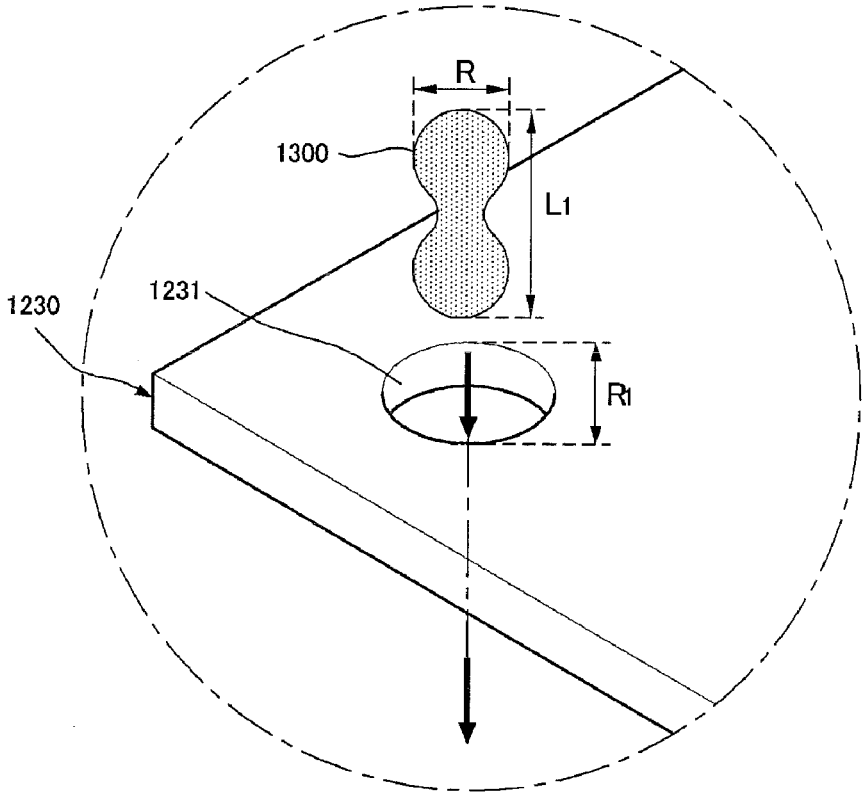

A filter unit 1230, as shown in FIG. 13B, passes the double egg bead 1300 through a hole 1231 of the filter unit 1230 in a longitudinal direction of the double egg bead 1300 to filter the double egg bead 1300. The size R of the double egg bead 1300 is smaller than a diameter R1 of the hole 1231.

Figure 13C:
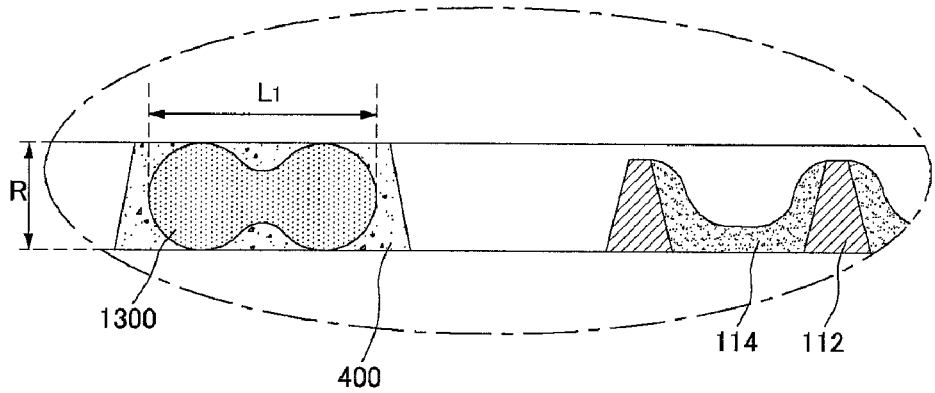

The double egg bead 1300, as shown in FIG. 13C, may be positioned inside the seal layer 400 in a transverse direction of the double egg bead 1300.

Because the fixing device applies a pressure to the front substrate and the rear substrate in the coalescing process of the front and rear substrates, the double egg bead 1300 is positioned inside the seal layer 400 in a direction capable of bearing the pressure, for instance, in the transverse direction as shown in FIG. 13C.

The size R of the double egg bead 1300 may be defined as the diameter R1 of the hole 1231 of the filter unit 1230 so as to filter the double egg bead 1300. Further, the size R of the double egg bead 1300 may be defined as a largest section length of the double egg bead 1300 in a direction perpendicular to a direction passing through the hole 1231.

Figure 13D:
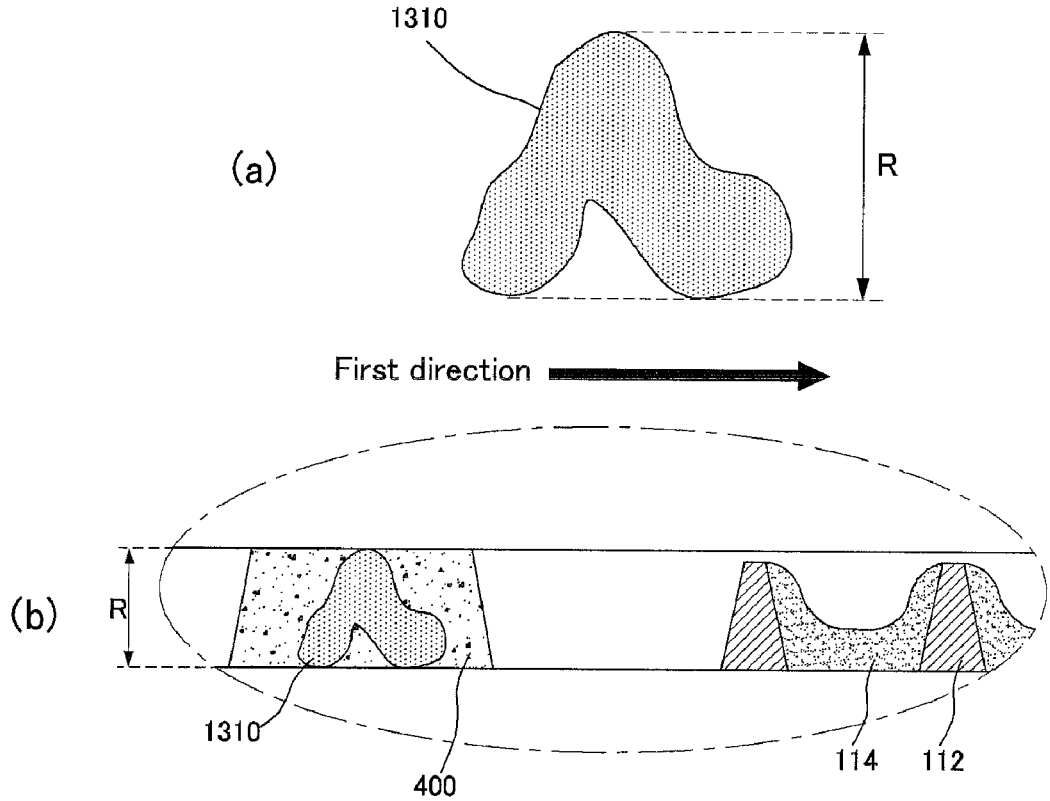

As shown in FIG. 13D, a double egg bead 1310 shown in (a) may be positioned inside the seal layer 400 in a direction capable of effectively dispersing a pressure applied to the front substrate and the rear substrate. For instance, the double egg bead 1310 may be positioned as shown in (b) of FIG. 13D.

The double egg bead 1310 may pass through the hole 1201 of FIG. 12 in a first direction, and also may be positioned inside the seal layer 400 in a direction parallel to the first direction.

A size R of the double egg bead 131 may be defined as a length of the double egg bead 1310 in a direction perpendicular to the first direction.

Figures 14A, 14B:
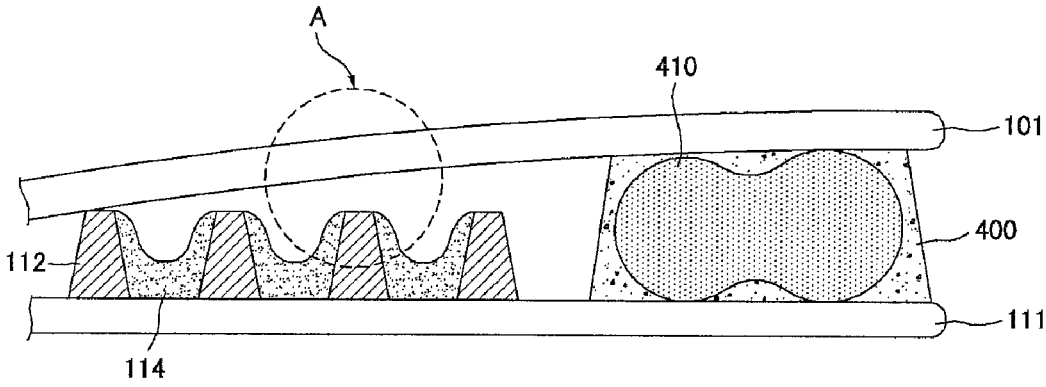
FIGS. 14A to 14C are diagrams for explaining a relationship between a size of a bead and a height of a barrier rib.
Figure 14C:
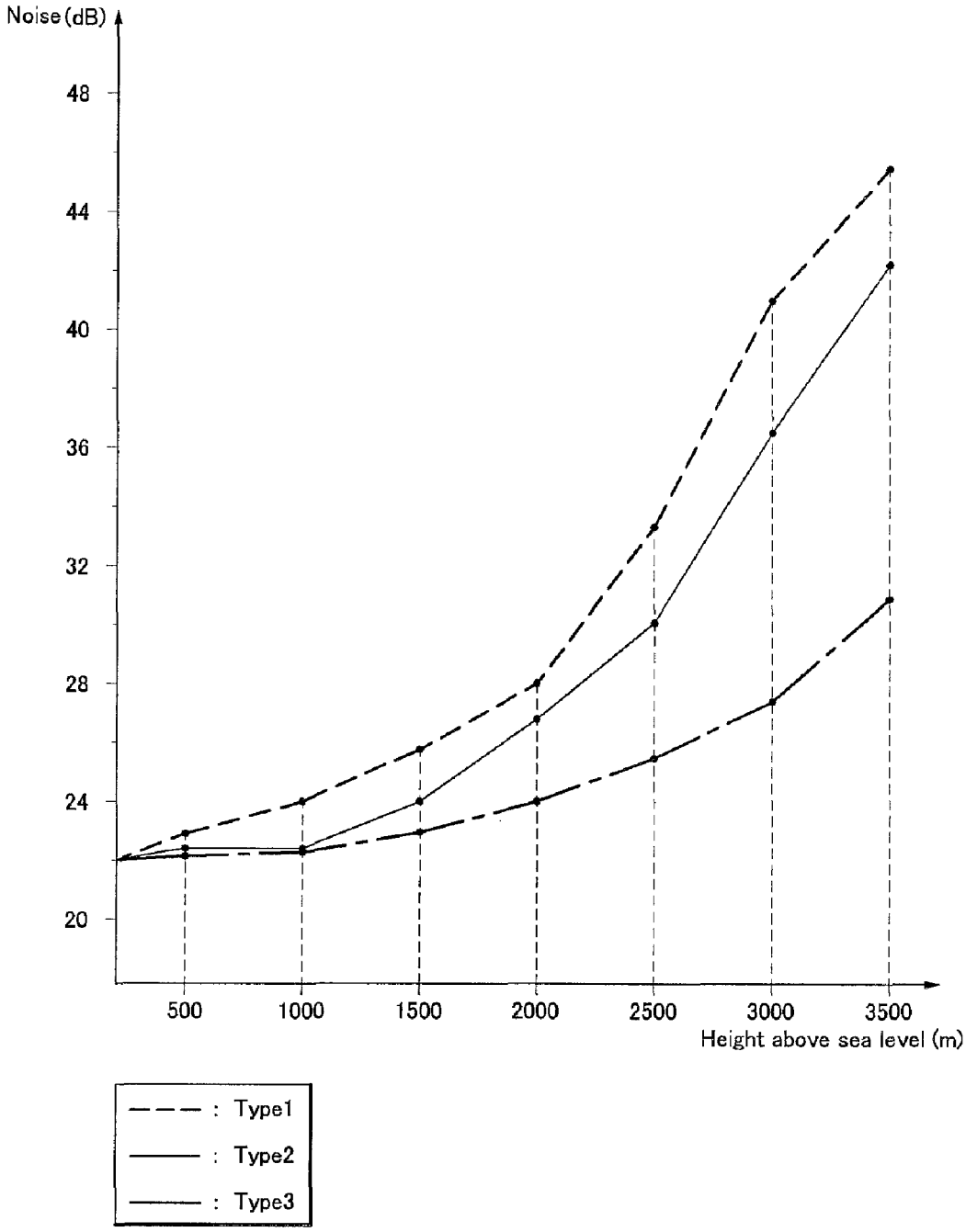

FIGS. 14A to 14C are diagrams for explaining a relationship between a size of a bead and a height of a barrier rib.

In FIGS. 14A to 14C, when a height h of the barrier rib 112 is 125 μm and a ratio R/h of the size R of the bead to the height h of the barrier rib 112 ranges from 0.9 to 1.8, a noise generated during the drive of the plasma display panel is measured and the generation of crosstalk between the adjacent discharge cells is observed.

The noise is measured on condition that a noise measuring device is disposed at 1 m of the plasma display panel ahead and the same video data is supplied to the plasma display panel. Supposing that the size R of the bead is substantially equal to a height of the seal layer.

As shown in FIG. 14A, when the ratio R/h ranges from 0.9 to 0.95, the front substrate may contact the barrier rib because the size R of the bead is smaller as compared with the height h of the barrier rib. Therefore, the noise may increase due to the frequent collision of the front substrate and the barrier rib during the drive, and thus a panel state is bad (X).

When the ratio R/h is 1.01, the collision of the front substrate and the barrier rib can be prevented because the size R of the bead is proper. Accordingly, the generation of noise may decrease, and thus the panel state is good (○). In this case, although the noise occurs, the generation amount of noise may be small.

When the ratio R/h is equal to or more than 1.04, the size R of the bead is large as compared with the height h of the barrier rib and an interval between the barrier rib and the front substrate can be sufficiently secured. Since the collision of the front substrate and the barrier rib can be prevented even if a vibration occurs during the drive, the generation of noise can be efficiently prevented and the panel state is excellent (◎).

When the ratio R/h is 0.9, a path of charge transfer between the adjacent discharge cells cannot be provided because the front substrate may contact the barrier rib. Accordingly, because the generation of crosstalk due to the charge transfer between the adjacent discharge cells can be reduced, the panel state is good (○). In this case, since a middle portion of the front substrate may be more convex than an edge portion thereof, a path of the charge transfer between the adjacent discharge cells may be provided. However, although the crosstalk occurs, the generation amount of crosstalk may be small.

When the ratio R/h is 1.45, the front substrate is spaced apart from the barrier rib at a proper distance therebetween, and thus the generation of crosstalk is reduced. Although the charge transfer between the adjacent discharge cells occurs, the generation amount of crosstalk may be small.

When the ratio R/h ranges from 0.95 to 1.37, the front substrate is spaced apart from the barrier rib at a sufficiently small interval therebetween so as to prevent the crosstalk between the adjacent discharge cells. Accordingly, the crosstalk may decrease and the panel state is excellent (◎).

When the ratio R/h is equal to or more than 1.7, as shown in FIG. 14B, the height of the seal layer 400 may be excessively higher than the height h of the barrier rib 112. An interval between the front substrate 101 and the barrier rib 112, as sown in an area A of FIG. 14B, may excessively widen. Therefore, the crosstalk may increase and the panel state is bad (X).

FIG. 14C is a graph showing a relationship between a height above sea level and a noise.

A 1-typed plasma display panel indicates a case where the seal layer does not a bead; a 2-typed plasma display panel indicates a case where a ratio R/h of the size R of the bead to the height h of the barrier rib is 1.0 (i.e., the size R of the bead is substantially equal to the height h of the barrier rib); and a 3-typed plasma display panel indicates a case where a ratio R/h of the size R of the bead to the height h of the barrier rib is 1.1.

When the 1-, 2- and 3-typed plasma display panels are driven at 0 m, 500 m, 1,000 m, 1,500 m, 2,000 m, 2,500 m, 3,000 m, and 3,500 m above sea level, a noise is measured.

The amount of noise is calculated by measuring the noise at each frequency of 0.5 kHz, 1 kHz, 2 kHz, 4 kHz, 8 kHz and 16 kHz and then adding the noises measured at the frequencies. The other experimental conditions are the same as those of FIGS. 14A to 14C.

The 1-, 2- and 3-typed plasma display panels may have a noise of about 22 dB at 0 m above sea level.

The 1-typed plasma display panel may have a noise of about 22.7 dB, about 24 dB, about 25.8 dB, about 28 dB, about 33.4 dB, about 40.9 dB and about 45.5 dB at 500 m, 1,000 m, 1,500 m, 2,000 m, 2,500 m, 3,000 m, and 3,500 m above sea level, respectively.

In the 1-typed plasma display panel not including the bead, as the height above sea level rises from 0 m to 3,500 m, the noise rises from 22 dB to 45.5 dB.

As the height above sea level rises, an internal pressure of the plasma display panel is higher than an external air pressure of the panel. Hence, a small interval is provided between the front substrate and the barrier rib, and the front substrate frequently collides with the barrier rib due to a vibration during the drive, thereby greatly generating the noise. For instance, the noise may occur due to the collision of the protective layer on the front substrate and the barrier rib on the rear substrate.

The 2-typed plasma display panel may have a noise of about 22.3 dB, about 22.3 dB, about 24 dB, about 26.7 dB, about 30.1 dB, about 36.5 dB and about 42.2 dB at 500 m, 1,000 m, 1,500 m, 2,000 m, 2,500 m, 3,000 m, and 3,500 m above sea level, respectively.

In the 2-typed plasma display panel, as the height above sea level rises from 0 m to 3,500 m, the noise rises from 22 dB to 42.2 dB.

The 3-typed plasma display panel may have a noise of about 22.1 dB, about 22.2 dB, about 23.1 dB, about 24 dB, about 25.8 dB, about 27.5 dB and about 30.6 dB at 500 m, 1,000 m, 1,500 m, 2,000 m, 2,500 m, 3,000 m, and 3,500 m above sea level, respectively.

In the 3-typed plasma display panel, as the height above sea level rises from 0 m to 3,500 m, the noise rises from 22 dB to 30.6 dB.

Considering the description of FIGS. 14A to 14C, the ratio R/h may range from 1.01 to 1.45. Further, the ratio R/h may range from 1.04 to 1.37.

The noise associated with the height above sea level in FIG. 14C can be reduced by adjusting a pressure of the discharge gas of the plasma display panel.

For instance, in cast that a gas pressure inside the panel is excessively high (i.e., an internal pressure of the panel is higher than an external air pressure of the panel), the front substrate may frequently collide with the barrier rib during the drive. Hence, the generation of noise may increase. In this case, even if the height above sea level is slightly higher, the generation amount of noise may sharply increase.

On the contrary, in case that the gas pressure inside the panel is excessively low, the number of particles of the discharge gas may decrease. Hence, the amount of ultraviolet rays generated by the discharge gas during the drive may decrease, and a luminance of an image may be reduced. Accordingly, a pressure of the discharge gas may be 350 torr to 450 torr.

Figure 15:
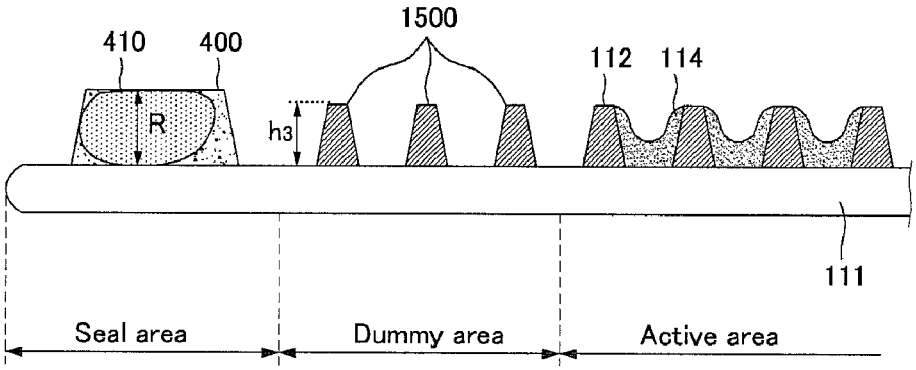
FIG. 15 is a diagram for explaining a dummy barrier rib.

FIG. 15 is a diagram for explaining a dummy barrier rib.

As shown in FIG. 15, the plasma display panel may include an active area where the discharge cell partitioned by the barrier rib 112 is positioned, a dummy area where a dummy barrier rib 1500 is positioned, and a seal area where the seal layer 400 is positioned.

The dummy area may be positioned outside the active area, and the seal area may be positioned outside the dummy area. The dummy barrier rib 1500 may be positioned between the seal layer in the seal area and the barrier rib 112 in the active area.

The phosphor layer 114 may be positioned inside the discharge cell of the active area. A dummy discharge cell may be partitioned by the dummy barrier rib 1500 in the dummy area. The phosphor layer 114 may or may not be positioned inside the dummy discharge cell.

A height h3 of the dummy barrier rib 1500 may be smaller than the height of the seal layer 400. The height h3 of the dummy barrier rib 1500 may be smaller than the size R of the bead 410 included in the seal layer 400. Accordingly, the generation of noise can be reduced.

Figure 16:
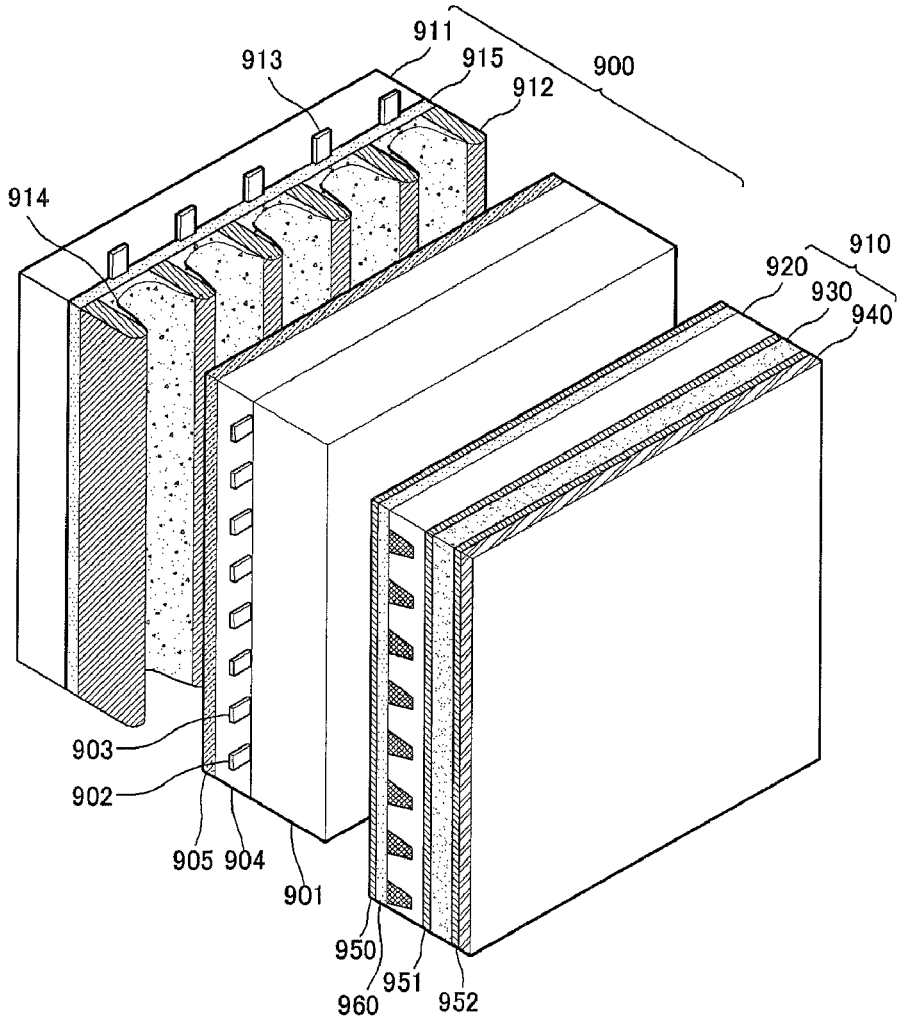
FIG. 16 illustrates an example of a plasma display apparatus according to the exemplary embodiment.

FIG. 16 illustrates an example of a plasma display apparatus according to the exemplary embodiment.

As shown in FIG. 16, the plasma display apparatus according to the exemplary embodiment includes a plasma display panel 900 displaying an image and a display filter 910. The plasma display panel 900 was described in detail through FIGS. 1 to 15.

The display filter 910 may include a shielding layer 920 for shielding light coming from the outside. The display filter 910 may further include a color layer 930 and an electromagnetic interference (EMI) shielding layer 940.

A second adhesive layer 951 may be positioned between the shielding layer 920 and the color layer 930 to attach the shielding layer 920 to the color layer 930. A third adhesive layer 952 may be positioned between the color layer 930 and the EMI shielding layer 940 to attach the color layer 930 to the EMI shielding layer 940.

A reference numeral 960 indicates a substrate. The substrate 960 provides a space capable of forming the shielding layer 920, the color layer 930 and the EMI shielding layer 940. The substrate 960 may be formed of a polymer resin.

The display filter 910 may further include a near infrared shielding layer.

Locations of the shielding layer 920, the color layer 930, the EMI shielding layer 940 and the substrate 960 may change. For instance, the EMI shielding layer 940 may be positioned on the substrate 960, the color layer 930 may be positioned on the EMI shielding layer 940, and the shielding layer 920 may be positioned on the color layer 930.

The display filter 910 may be positioned in front of the plasma display panel 900. The display filter 910 may be a film filter. For instance, the display filter 910 may include a first adhesive layer 950, and the display filter 910 may be attached to a front surface of the plasma display panel 900 using the first adhesive layer 950.

A reason why the display filter 910 is a film filter will be described below.

The display filter 910 may be mainly classified into a glass filter and a film filter.

The glass filter has a structure in which at least one functional layer is staked on a glass substrate that is a basic layer. The glass filter may be spaced apart from the front surface of the plasma display panel at a predetermined distance.

The film filter is more inexpensive than the glass filter, and can be easily attached to the front surface of the plasma display panel through a lamination method. A structure for holding and supporting the glass filter is necessary to position the glass filter in front of the plasma display panel, thereby increasing the manufacturing cost of the glass filter.

Because the glass substrate is the basic substrate in the glass filter, the glass filter can prevent a noise generated in the plasma display panel during the drive from being discharged to the outside to some extent.

On the other hand, because the film filter is based on the substrate formed of, e.g., the polymer resin, a prevention level of a noise generated in the plasma display panel during the drive in the film filter is lower than a prevention level of the noise in the glass filter. The film filter may cause the problem of noise.

When a seal layer used to attach the front and rear substrates of the plasma display panel includes beads and a size of the bead is larger than a height of the barrier rib, the generation of noise can be reduced.

Because the plasma display panel according to the exemplary embodiment includes the beads, the generation of noise can be reduced.

Although the film filter positioned in front of the plasma display panel including the beads does not prevent a noise generated in the plasma display panel during the drive, the noise problem can be solved and the manufacturing cost can be reduced.

Accordingly, since the plasma display panel according to the exemplary embodiment includes the seal layer including the beads and the film filter as a display filter, a reduction in the manufacturing cost as well as the prevention of noise can be achieved.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display panel comprising:

a front substrate on which an upper dielectric layer is positioned;

a rear substrate on which a lower dielectric layer is positioned, the rear substrate being positioned to be opposite to the front substrate;

a barrier rib positioned between the front substrate and the rear substrate; and a seal layer positioned between the front substrate and the rear substrate, the seal layer including a plurality of beads, at least one of the plurality of beads including a head portion, a body portion, and a connection portion connecting the head portion to the body portion, wherein the head portion contacts the upper dielectric layer and the lower dielectric layer, and wherein the body portion contacts the upper dielectric layer and the lower dielectric layer, and wherein a size of the connection portion is smaller than a size of the head portion and a size of the body portion.

2. The plasma display panel of claim 1, wherein a size of the bead is larger than a height of the barrier rib.

3. The plasma display panel of claim 2, wherein a ratio of the size of the bead to the height of the barrier rib ranges from 1.01 to 1.45.

4. The plasma display panel of claim 1, wherein a height of the seal layer is larger than a height of the barrier rib.

5. The plasma display panel of claim 1, wherein an upper dielectric layer is positioned on the front substrate, and a lower dielectric layer is positioned on the rear substrate, and a size of the bead is substantially equal to an interval between the upper dielectric layer and the lower dielectric layer.

6. A plasma display panel comprising:

a front substrate on which an upper dielectric layer is positioned;

a rear substrate on which a lower dielectric layer is positioned, the rear substrate being opposite to the front substrate;

a barrier rib positioned between the front substrate and the rear substrate; and a seal layer positioned between the front substrate and the rear substrate, the seal layer including a plurality of beads, wherein a ratio of a thickness of the upper dielectric layer to a size of each of the beads ranges from 0.125 to 0.42 and wherein at least one bead has:

a first section of a first size, a second section of a second size different from the first size, and a third section between the first and second sections and having a size smaller than the first and second sizes.

7. The plasma display panel of claim 6, wherein the ratio of the thickness of the upper dielectric layer to the size of the at least one bead ranges from 0.13 to 0.35.

8. The plasma display panel of claim 6, wherein a ratio of a thickness of the lower dielectric layer to the size of the at least one bead ranges from 0.05 to 0.17.

9. The plasma display panel of claim 8, wherein the ratio of the thickness of the lower dielectric layer to the size of the at least one bead ranges from 0.055 to 0.14.

10. The plasma display panel of claim 6, wherein the size of the at least one bead is larger than a height of the barrier rib.

11. The plasma display panel of claim 10, wherein a ratio of the size of the at least one bead to the height of the barrier rib ranges from 1.01 to 1.45.

12. The plasma display panel of claim 6, wherein a height of the seal layer is larger than a height of the barrier rib.

13. The plasma display panel of claim 6, wherein the size of the at least one bead is substantially equal to an interval between the upper dielectric layer and the lower dielectric layer.

14. The plasma display panel of claim 6, further comprising:

at least another bead having only one of the first, second, or third sections located adjacent the at least one bead.

15. The plasma display panel of claim 6, wherein only the first section contacts the upper and lower dielectric layers and the second section contacts only one of the upper or lower dielectric layers.

* * * * *